US005906791A

United States Patent [19]

Angeliu

[11] Patent Number: 5,906,791

[45] Date of Patent: May 25, 1999

[54] STEEL ALLOYS

[75] Inventor: Thomas Martin Angeliu, Clifton Park, N.Y.

[73] Assignee: General Electric Company, Schenectady, N.Y.

[21] Appl. No.: 09/123,761

[22] Filed: Jul. 27, 1998

Related U.S. Application Data

[63] Continuation-in-part of application No. 08/901,844, Jul. 28, 1997, Pat. No. 5,820,817.

[51] Int. Cl.[6] ..... C22C 38/22

[52] U.S. Cl. ..... 420/40; 420/67; 420/70

[58] Field of Search ..... 420/40, 67, 70

[56] References Cited

U.S. PATENT DOCUMENTS

| | | |
|---|---|---|
| 4,564,392 | 1/1986 | Ohhashi et al. . |
| 5,320,687 | 6/1994 | Kipphut et al. . |

FOREIGN PATENT DOCUMENTS

| | | |
|---|---|---|
| 55-2775 | 10/1980 | Japan . |
| 62-170461 | 7/1987 | Japan . |
| 472039 | 6/1992 | Japan . |
| 95026351 | 7/1993 | Japan . |
| 103447 | 8/1995 | Japan . |

OTHER PUBLICATIONS

Chengjian, Iron and Steel, Grain Boundary Segregation of Ce, Mo and P and Temper Embrittlement of Steel, vol. 26, No. 12, Dec. 1991, pp. 29–35.

Kaneko, Journal of the Japan Institute of Metals, vol. 29, Aug. 14, 1964, pp. 166–170.

Wall et al., AERE R11109, "Thermal Ageing Studies of 9%Cr 1% Mo Steel", Jan. 1984, 41 pages.

Mandziej et al., Fresenius Z Anal Chem, Transmission Electron Microscope and Scanning Auger Investigations of Temper–Embrittled 12% Cr Steel, (1987), 329, pp. 335–341.

Schinkel et al., American Society for Metals, Heat Treatment, Ageing Effects and Microstructure of 12% Cr Steel, pp. 131–149, 1983.

Barrett et al., Scripta Metallurgica, vol. 21, No. 2, (1987), "The Effect of Sulphur on the Temper Embrittlement Susceptibility of a Rare Earth–Containing Low Alloy Steel", pp. 123–128.

Seah et al., Metal Science, May 1979, Additive Remedy for Temper Brittleness, pp. 307–314.

*Primary Examiner*—Deborah Yee

*Attorney, Agent, or Firm*—Ernest G. Cusick; Noreen C. Johnson

[57] ABSTRACT

A steel comprises additives including rare earth elements, boron and at least one of rhenium, osmium, iridium, ruthenium, rhodium. The steel exhibits resistance to embrittlement, oxidation and creep. The steel also comprises balanced amounts of nickel and cobalt to minimize a ratio of nickel to cobalt, and optimize aging embrittlement resistance with as tempered toughness. The steel comprises, by weight percent: at least one of rhenium, osmium, iridium, ruthenium, rhodium (0.01 to 2.00); rare earth element (0.50 max.); boron (0.001–0.04); carbon (0.08–0.15); silicon (0.01–0.10); chromium (8.00–13.00); at least one of tungsten and molybdenum (0.01 to 2.00); at least one austenite stabilizer; such as nickel, copper, cobalt and manganese (0.001–6.00); vanadium (0.25–0.40); phosphorus (0.010 max.); sulfur (0.004 max.); nitrogen (0.060 max.); hydrogen (2 ppm max.); oxygen (50 ppm max.); aluminum (0.001–0.025); arsenic (0.0060 max.); antimony (0.0030 max.); tin (0.0050 max.); iron (balance).

12 Claims, No Drawings

STEEL ALLOYS

This application is a continuation-in-part of U.S. Ser. No. 08/901,844 filed Jul. 28, 1997, now U.S. Pat. No. 5,820,817, issued Oct. 13, 1998. The contents of U.S. Ser. No. 08/901,844 are fully incorporated herein.

FIELD OF THE INVENTION

The invention is directed to steels. In particular, the invention is directed to steels with alloy constituents that improve characteristics and properties of the steel.

BACKGROUND OF THE INVENTION

Turbine components must maintain physical and thermal properties for useful applications. Turbine components are subject to high temperatures, and thus are readily oxidized. Turbine components are also subject to high stresses during operation that often lead to creep (deformation under a steady load, especially at elevated temperatures) of the turbine's material. Turbine components therefore should be formed from a material that maintains its mechanical properties, such as, but not limited to, enhanced creep resistance and lack of embrittlement, and does not readily oxidize at elevated temperatures.

Turbine components are often formed from steel materials. Steels exhibit excellent strength, low brittle to ductile transition temperatures and good hardening characteristics. Steels, however, are subject to oxidation, embrittlement, and creep on exposure to elevated temperatures. The embrittlement is due, at least in part, to formation of detrimental phases within alloy grains (irreversible embrittlement) or to segregation of some harmful elements to grain boundaries (reversible embrittlement) at elevated temperatures. Steels for turbine component applications must be formed with constituents that reduce steel embrittlement, oxidation and creep.

Conventional steel alloys for turbine components include high alloy steels. High alloy steels include steels with a chromium (Cr) content above 10%, for example about 12% by weight percent. High alloy steels include, but are but not limited, to Fe—12Cr stainless steels (hereinafter Fe—12Cr steels), which are known in the art. One such steel is disclosed in U.S. Pat. No. 5,320,687 to Kipphut et al., the entire contents of which are fully incorporated herein by reference.

Common steel alloying constituents comprise, but are not limited to, tungsten (W) and cobalt (Co). For example, an addition of tungsten to a steel requires either (1) a decrease in a chromium (Cr) content to maintain a balance of ferrite stabilizers in the steel; or (2) additional austenite stabilizers, such as, but not limited to, nickel (Ni), manganese (Mn), and cobalt, to maintain an adequate steel oxidation resistance. Since most austenite stabilizers are expensive (cobalt) or detrimental to creep properties (nickel), an austenite stabilizer addition does not maintain a steel's oxidation and creep resistance. Steel manufacturers thus have attempted to decrease the chromium content in steels for turbine components. A low chromium content does not add much cost to the manufacture of the steel, and does not adversely effect creep properties. A low chromium content in steel, however, is detrimental to oxidation resistance, and is undesirable.

Further attempts to solve a steel's oxidation resistance problems include addition of one or both of chromium and silicon (Si). Chromium and silicon are added to enhance oxidation resistance of steels, which, of course, is desirable. These solutions, however, have not proved effective or desirable as a higher chromium content, while enhancing oxidation resistance, undesirably increases embrittlement in steels by an alpha prime (γ) phase formation. Also, the silicon addition romotes formation of undesirable, embrittling Laves phases in steels.

Accordingly, it is desirable to provide a steel composition that provides suitable performance in high temperature applications, with balanced mechanical and oxidation properties. For example, a steel for high temperature turbine components applications should exhibit reduced oxidation, while balancing desirable mechanical properties, such as enhanced creep resistance and reduced embrittlement at high temperatures.

SUMMARY OF THE INVENTION

Accordingly, the invention provides a steel alloy composition that overcomes deficiencies of known steel compositions. A steel, in accordance with the invention, is a boron and rare earth element(s) comprising steel, with at least one of rhenium, osmium, iridium, ruthenium, rhodium, platinum, palladium. The steel comprises, by weight percent:

| | |
|---|---|
| At least one of: Rhenium, Osmium, Iridium Ruthenium, Rhodium, Platinum, Palladium | 0.01 to 2.00 |
| Rare earth element | 0.50 max. |
| Boron | 0.001–0.04 |
| Carbon | 0.08–0.15 |
| Silicon | 0.01–0.10 |
| Chromium | 8.00–13.00 |
| At least one of Tungsten and Molybdenum | 0.50–4.00 |
| At least one Austenite stabilizer, such as Nickel, Cobalt, Manganese, and Copper | 0.001–6.00 |
| Vanadium | 0.25–0.40 |
| Phosphorus | 0.010 max. |
| Sulfur | 0.004 max. |
| Nitrogen | 0.060 max. |
| Hydrogen | 2 ppm max. |
| Oxygen | 50 ppm max. |
| Aluminum | 0.001–0.025 |
| Arsenic | 0.0060 max. |
| Antimony | 0.0030 max. |
| Tin | 0.0050 max. |
| Iron | Balance. |

DETAILED DESCRIPTION OF THE PREFERRED EMBODIMENTS

A steel, in accordance with an embodiment of the invention, balances mechanical and oxidation properties by adding alloying constituents, including precious metals, rare earth element(s), rhenium, and boron. The steel reduces long term aging embrittlement (herein aging embrittlement), and maintains, and preferably increases, yield and creep strengths. The precious metal is selected from the group that includes, but is not limited to platinum group metals, such as ruthenium (Ru), rhodium (Rh), osmium (Os), platinum (Pt), palladium (Pd), and iridium (Ir), and mixtures thereof.

An exemplary steel composition, as embodied by the invention, is set forth in Table 1. The steel composition includes iron, rare earth element, boron, at least one of rhenium and platinum group metals, carbon, silicon, chromium, at least one of tungsten and molybdenum, at least one Austinite stabilizer, vanadium, and aluminum. The percents are approximate weight percents, and the ranges extend from about the first value to about the second value.

Where a constituent's weight value is given in terms of a maximum ("max."), the material is provided in amounts in a range form about zero to about "max.", but does not exceed "max.". A material amount defines as "balance" means that the material amount is a remainder of the composition after other constituents have been added. Further, wherever percent or proportion is stated, reference is to a weight percent basis, unless otherwise expressly noted.

TABLE 1

| | |
|---|---|
| At least one of: Rhenium, Osmium, Iridium Ruthenium, Rhodium, Platinum, and Palladium | 0.01 to 2.00 |
| Rare earth element | 0.50 max. |
| Boron | 0.001–0.04 |
| Carbon | 0.08–0.15 |
| Silicon | 0.01–0.10 |
| Chromium | 8.00–13.00 |
| At least one of Tungsten and Molybdenum | 0.50–4.00 |
| At least one Austenite stabilizer, such as Nickel, Cobalt, Manganese, and Copper | 0.001–6.00 |
| Vanadium | 0.25–0.40 |
| Phosphorus | 0.010 max. |
| Sulfur | 0.004 max. |
| Nitrogen | 0.060 max. |
| Hydrogen | 2 ppm max. |
| Oxygen | 50 ppm max. |
| Aluminum | 0.001–0.025 |
| Arsenic | 0.0060 max. |
| Antimony | 0.0030 max. |
| Tin | 0.0050 max. |
| Iron | Balance. |

Platinum group metals and rhenium (Re) enhance solid solution strengthening of a steel, and platinum group metals provide oxidation resistance. These metals are positioned proximate tungsten (W) in the Periodic Table of the Elements, and possess similar beneficial solid solution strengthening effects for steels, as does tungsten. These platinum group metals include ruthenium (Ru), rhodium (Rh), osmium (Os), platinum (Pt), palladium (Pd), and iridium (Ir). Iridium possesses very effective corrosion and oxidation resistant properties, and thus its addition to steel would enhance a steel's corrosion and oxidation resistance properties. Rhenium enhances solid strength solutioning of steels, as does platinum group metals. Platinum group metals enhance oxidation resistance of steels, and possibly provide benefits from second phase and precipitate formation, when the platinum group metals are provided in amounts in a range between about 5 to about 10 weight percent.

Rare earth elements improve a steel's aging embrittlement resistance as the impurity content is lower. An exact rare earth element amount in a steel depends on a steel's impurity content. More rare earth elements are needed as a steel's impurity level increases. For example, depending on an impurity level, the rare earth element amount is provided in an amount up to about 0.5 weight percent of the steel, such as in a range between about 0.1 and about 0.2 weight percent. Further, the rare earth element amount is in a range between about 0.1 and about 0.15, for example about 0.1 weight percent.

Several rare earth elements are effective for reducing aging embrittlement in steels. These rare earth elements include, but are not limited to, yttrium, lanthanum, cerium, praseodymium, neodymium, promethium, samarium, and erbium, alloys of these metals and combinations. One embodiment of the invention provides at least one of lanthanum and yttrium in an amount in a range between about 0.01 to about 0.3 weight percent, such as in a range between about 0.1 and 0.15. For example, an amount of at least one of lanthanum and yttrium is about 0.1 weight percent.

Rare earth elements also control formation of segregants in steels. For example, lanthanum has been determined to reduce segregant formation in a steel.

Boron, in a steel, segregates to grain boundaries, occupies these grain boundary sites, and prevents other segregants from occupying the sites. Boron is provided in a steel, as embodied by the invention, in amounts in a range between about 0.01 to about 0.04 weight percent. Boron at the grain boundary sites prevents weakening of the steel, and thus reduces aging embrittlement. Accordingly, boron, when it occupies grain boundary sites, mitigates a decrease in fracture toughness in steels. Also, boron is not detrimental to grain boundary site strength, and is beneficial to increased cohesion of steels. Further, boron is believed to enhance creep resistance properties of steels.

An impurity reduction in steels reduces alpha prime constituents, and thus reduces aging embrittlement and improves aging and temper embrittlement resistance. The impurity reduction in a steel is accomplished by at least one of preventing impurities from occupying grain boundaries, as in the addition of boron, and reducing at least one, and preferably both, of silicon and aluminum amounts in a steel. Alpha prime reduction and temper embrittlement resistance improvement are accomplished by the modification of, for example by balancing, amounts of two of chromium, molybdenum and tungsten.

Silicon is provided in a steel, as embodied by the invention, in amounts between about 0.01 to about 0.1 weight percent. Aluminum is provided in a steel, as embodied by the invention, in amounts between about 0.001 to about 0.025 weight percent. Both of these constituents in the above amounts tend to prevention of impurities at grains boundaries.

A steel, in accordance with the invention, comprises chromium, which enhances aging embrittlement resistance (chromium also enhances oxidation resistance). The chromium amount is provided in a range between about 8.0 to about 13.0 weight percent, such as in a range between about 8.0 to about 12.0 weight percent.

The Austenite stabilizer comprises known Austenite stabilizers, and includes, but is not limited to, nickel, cobalt, copper, magnesium, and combinations of these elements, with cobalt in some amount. The Austenite stabilizer amount in the steels is provided in a range between about 0.001 to about 6.0 weight percent. The Austenite stabilizer comprises as much cobalt as possible, while minimizing a nickel amount and keeping the Austenite stabilizer in a range between about 0.001 to about 6.0 weight percent. While nickel, as a constituent in a steel, provides desirable as-toughness properties, cobalt as an Austenite stabilizer is preferable (if possible) since nickel causes undesirable aging characteristics, such as increasing embrittlement. Thus, nickel and cobalt amounts are preferably balanced to enhance aging embrittlement resistance with as-tempered toughness.

A steel, as embodied by the invention, comprises carbide stabilizers. Carbide stabilizers comprise at least one of tungsten and molybdenum. The carbide stabilizers are desirable in steels, as they enhance solid solution strengthening. The carbide stabilizer amount is preferably in a range between about 0.50 to about 4.00, by weight percent of the steel.

Further, a steel, according to an embodiment of the invention, contains niobium (Nb) in amounts up to 0.50 weight percent to enhance toughness and creep resistance properties of a steel. Niobium, when provided in amounts between about 0.01 to about 0.5 weight percent, such as about 0.05 weight percent of the steel, controls inclusions and enhances a fine grain structure, such as a line martensite structure. A fine grain structure, coupled with a controlled grain size, as provided by niobium, enhances toughness properties of steels.

A relatively fine grain structure, which enhances toughness properties of a steel, is also provided by a low weight percent of nickel, copper, manganese and cobalt in a steel, where the total weight percent of these constituents is less than about 6.0. For example, a steel, in accordance with an embodiment of the invention, comprises nickel in a range between about 0.1 to about 4.0 and cobalt in a range between about 0.5 to about 6.0, by weight percent. Alternatively, a steel comprises nickel in a range between about 0.1 to about 2.0 and cobalt in a range between about 1.0 to about 4.0, by weight percent. As discussed above, a nickel amount is balanced with cobalt to prevent undesirable aging embrittlement effects, while maintaining its desirable toughness effects in steel.

Steel toughness is also enhanced by reducing and controlling segregants and second phase formation. Segregant and second phase formation reduction is achieved by reducing amounts of silicon, aluminum, nickel, manganese, sulfur, phosphorus, arsenic, tin and antimony in a steel. Alternatively, relatively low amounts of these constituents are provided to control segregant and second phase formation. For example, a steel should preferably not contain more than about 0.05 manganese, 0.01 silicon, 0.01 phosphorus, 0.005 tin, 0.003 antimony, 0.006 arsenic, 0.025 aluminum and 0.004 sulfur, all in weight percent. Thus, a steel with low segregant forming additions is termed as a "super clean" steel, and achieves enhanced toughness properties.

Second phase formation control increases a steels' toughness. Second phase formation control is further provided in a steel by stabilizing precipitates of at least one of molybdenum and tungsten. Molybdenum and tungsten control and improve creep resistance properties, and are thus desirable in controlled and balanced amounts in a steel. In accordance with an embodiment of the invention, a sum of the weight percent of molybdenum+½ the weight percent of tungsten equals about 1.5, i.e., $1.5 \geqq Mo + \frac{1}{2} W$. This relationship reduces second phase formation and improves creep resistance properties of steels.

While the embodiments described herein are disclosed, it will be appreciated from the specification that various combinations of elements, variations or improvements therein may be made by those skilled in the art are within the scope of the invention.

I claim:

1. A boron and rare earth element steel comprising, by weight percent of the steel:

| | |
|---|---|
| At least one of: Rhenium, Osmium, Iridium Ruthenium, Rhodium, Platinum, Palladium | 0.01 to 2.00 Total |
| Rare earth element | 0.50 max. Total |
| Boron | 0.001–0.04 |
| Carbon | 0.08–0.15 |
| Silicon | 0.01–0.10 |
| Chromium | 8.00–13.00 |
| At least one of Tungsten and Molybdenum | 0.50–4.00 Total |
| At least one Austenite stabilizer | 0.001–6.00 |
| Vanadium | 0.25–0.40 |
| Phosphorus | 0.010 max. |
| Sulfur | 0.004 max. |
| Nitrogen | 0.060 max. |
| Hydrogen | 2 ppm max. |
| Oxygen | 50 ppm max. |
| Aluminum | 0.001–0.025 |
| Arsenic | 0.0060 max. |
| Antimony | 0.0030 max. |
| Tin | 0.0050 max. |
| Iron | Balance. |

2. The steel according to claim 1, comprising less than about 0.05 weight percent manganese, 0.01 weight percent silicon, 0.01 weight percent phosphorus, 0.005 weight percent tin, 0.003 weight percent antimony, 0.0030 weight percent arsenic.

3. The steer according to claim 1, comprising not in excess of 0.05 manganese weight percent, 0.01 silicon weight percent, 0.01 phosphorus weight percent, 0.004 sulfur weight percent, 0.005 tin weight percent, 0.003 antimony weight percent, 0.006 arsenic weight percent.

4. The steel according to claim 1, the rare earth element is selected from the group consisting of:

yttrium, lanthanum, cerium, praseodymium, neodymium, promethium, samarium, erbium and combinations thereof.

5. The steel according to claim 1, wherein the amount of chromium is in a range between about 8.0 to about 12.0 weight percent.

6. The steel according to claim 1, wherein the amount of rare earth element is in a range between about 0.1 to about 0.2 weight percent.

7. The steel according to claim 1, wherein the amount of rare earth element is in a range between about 0.1 to about 0.15 weight percent.

8. The steel according to claim 1, wherein the amount of rare earth element is about 0.1 weight percent.

9. The steel according to claim 1, wherein the amount of nitrogen is in an amount less than about 0.060 weight percent.

10. The steel according to claim 1, wherein the amount of nitrogen is in an amount less than about 0.04 weight percent.

11. The steel according to claim 1, further comprising tungsten and molybdenum, an amount of tungsten being related to an amount of molybdenum, where 1.5 equals a weight percent of the amount of molybdenum plus ½ a weight percent of the amount of tungsten.

12. The steel according to claim 1, wherein the at least one Austinite stabilizer is selected from the group consisting of:

nickel, cobalt, manganese, and copper.

* * * * *